US007571520B2

(12) United States Patent
Shiue

(10) Patent No.: US 7,571,520 B2
(45) Date of Patent: Aug. 11, 2009

(54) ADJUSTABLE BUCKLE

(75) Inventor: Chih-Cheng Shiue, Escondido, CA (US)

(73) Assignee: QBAS Co., Ltd., Taipei (TW)

( * ) Notice: Subject to any disclaimer, the term of this patent is extended or adjusted under 35 U.S.C. 154(b) by 447 days.

(21) Appl. No.: 11/635,570

(22) Filed: Dec. 8, 2006

(65) Prior Publication Data

US 2008/0134480 A1 Jun. 12, 2008

(51) Int. Cl.

| | |
|---|---|
| ***A44B 11/26*** | (2006.01) |
| *A63B 33/00* | (2006.01) |
| *B63C 11/12* | (2006.01) |
| *A61F 9/02* | (2006.01) |

(52) U.S. Cl. ..... 24/265 BC; 24/296; 24/68 E

(58) Field of Classification Search ..... 24/265 EC, 24/265 BC, 68 BT, 68 E, 71.1; 2/426, 417, 2/418

See application file for complete search history.

(56) References Cited

U.S. PATENT DOCUMENTS 5,467,508 A * 11/1995 Feng ..... 24/3.3
6,457,210 B1 * 10/2002 Shirai et al. ..... 24/16 PB
6,871,386 B2 * 3/2005 Chen-Lieh ..... 24/68 E
6,966,102 B2 * 11/2005 Shiue ..... 24/196
7,458,134 B2 * 12/2008 Shiue ..... 24/68 E

* cited by examiner

*Primary Examiner*—Robert J Sandy

(57) ABSTRACT

An adjustable buckle includes a base including a top column; a hollow rectangular sliding plate slidably put on the column and including inclined front and rear ends each falling into a dip between two of a series of ratchet teeth of either strap, two inclined sides, and a resilient assembly secured on the sliding plate; and a cover including two parallel side walls, front and rear struts each with the strap partially wrapped around, and two latches each on the side wall. Pressing the latches will lift the sliding plate with the resilient assembly being compressed, disengage the front and rear ends with the dip, and enable the straps to slide through front and rear openings of the cover, and releasing the latches will cause the sliding plate to fall due to the expanding resilient assembly, and cause the front and rear ends to fall into the dip.

4 Claims, 7 Drawing Sheets

ADJUSTABLE BUCKLE

BACKGROUND OF THE INVENTION

1. Field of Invention

The invention relates to buckles and more particularly to an adjustable buckle for tightening or loosening two straps joined thereat, each strap being extended from either end piece of a mask (e.g., one used for swimming or diving, one worn by an athlete, or a safety mask).

2. Description of Related Art

A conventional mask (e.g., one used for swimming or diving, one worn by an athlete, or a safety mask) has one or two head straps. For a mask having a single strap, a strap tensioner is mounted at either end piece of the mask. For a mask having two straps each extended from either end piece of the mask, a buckle is generally disposed at a rear central portion of the brain when a person wears the mask. As comparing the buckle with the strap tensioners, the buckle is more advantageous because it is simple in construction and can simplify the mask component.

However, the construction of the well known buckle is complicated and its use is not unreliable. Thus, the need for improvement still exists.

SUMMARY OF THE INVENTION

It is therefore one object of the invention to provide a buckle for tightening or loosening two straps joined at the buckle, each strap being extended from either end piece of a mask and having a plurality of equally spaced transverse ratchet teeth formed on an inner surface, comprising a base including a top column; a rectangular sliding plate including a central hole shaped to slidably put on the column, inclined front and rear ends each falling into a dip between two adjacent teeth in a locked position of the buckle, two inclined sides, and a resilient assembly secured on the sliding plate; and a cover including a top bridge, front and rear openings, two parallel side walls secured to the base and each having an opening, front and rear struts formed across the side walls with the strap being partially wrapped around each strut, and two L-shaped latches each formed at the opening of the side wall between the struts, and the latch including a projecting outer surface wherein an end of each latch is disposed inside the cover and engaged with either side of the sliding plate, and wherein a top of the resilient assembly is biased against an inner surface of the bridge, whereby putting the mask on an object and pressing the outer surfaces of the latches toward each other will lift the sliding plate along the column with the resilient assembly being compressed by biasing against the bridge, cause the front and rear ends to clear the dip between the teeth, and enable the straps to freely slide through the front and rear openings of the cover by pulling free ends of the straps in a first direction, and stopping the pulling by releasing the latches will cause the sliding plate to slide downward by an expansion of the resilient assembly, cause the front and rear ends to fall into the dip between the teeth, and lock the straps; and whereby pulling the free ends of the straps in a second direction opposite the first direction will loosen the buckle and enable a removal of the mask from the object.

In one aspect of the invention the resilient assembly comprises four resilient members arranged as four corners of a rectangle around the hole.

In another aspect of the invention the resilient assembly is a coil spring.

In a further aspect of the invention the end of each latch is shaped as a hook.

The above and other objects, features and advantages of the invention will become apparent from the following detailed description taken with the accompanying drawings.

DETAILED DESCRIPTION OF THE INVENTION

Figure 1:
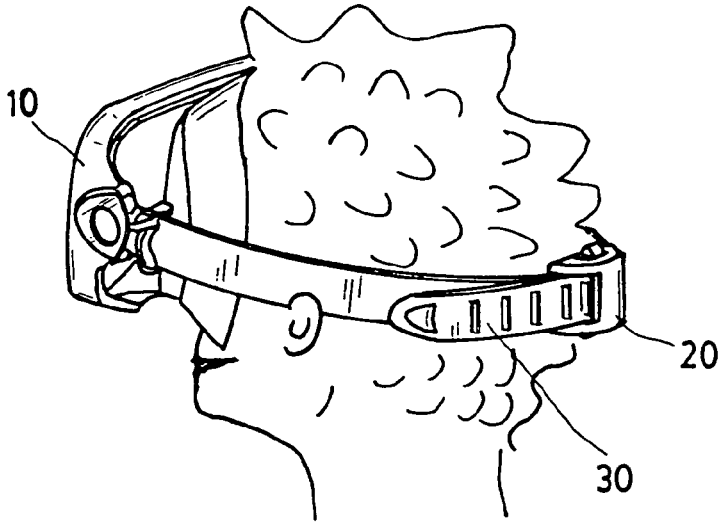
FIG. 1 is an environmental view of a first preferred embodiment of adjustable buckle according to the invention being worn on the head.
Figure 2:
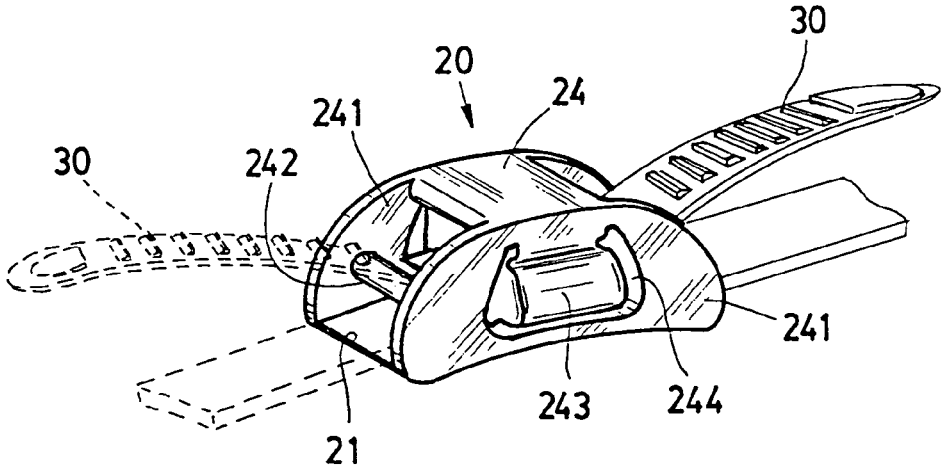
FIG. 2 is a perspective view of the buckle.
Figure 3:
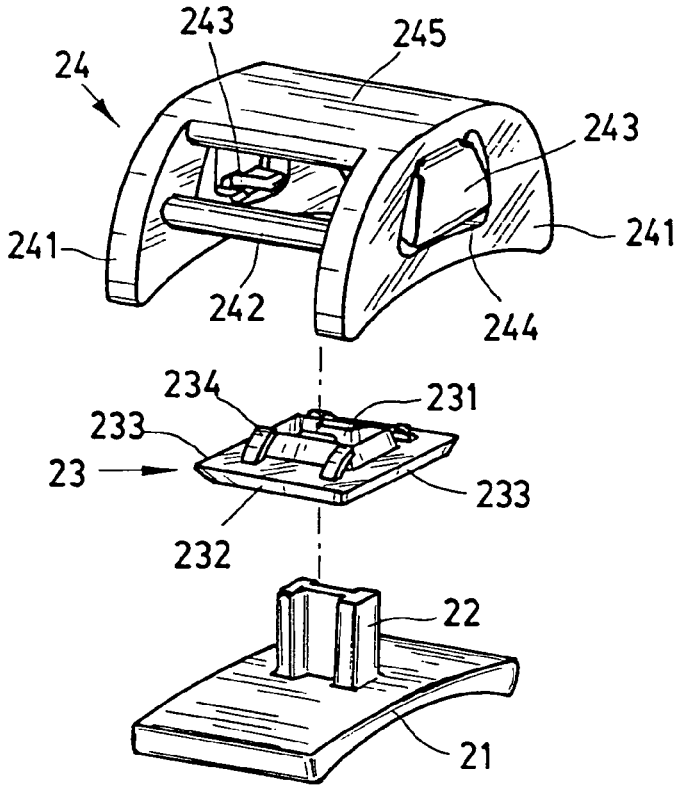
FIG. 3 is an exploded view of the buckle.
Figure 4:
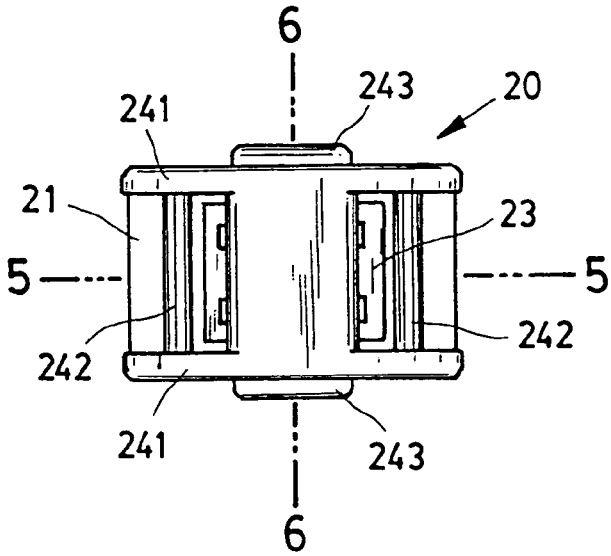
FIG. 4 is a top plan view of the buckle.

Referring to FIGS. 1 to 6B, an adjustable buckle 20 in accordance with a first preferred embodiment of the invention is shown. The buckle 20 as a component of a mask 10 is generally disposed at a rear central portion of the brain when a person wears the mask 10 by holding left and right straps 30 to the head.

Both the mask 10 and the straps 30 are well known devices except that the strap 30 comprises a plurality of equally spaced transverse ratchet teeth 31 formed on an inner surface. Thus, a detailed description thereof is therefore deemed unnecessary.

The buckle 20 as the subject of the invention comprises a rigid rectangular base 21 having a slightly curved bottom and including an upright column 22 of I-section on a top. Preferably, a pad is formed under the base 21 so as to provide a wearer with a degree of comfort while wearing the buckle 20 on the head.

The buckle 20 further comprises a rectangular sliding plate 23 including a central hole 231 shaped to slidably put on the column 22 (i.e., the sliding plate 23 adapted to slide upward or downward along the column 22 in operation as detailed later), inclined front and rear ends 232 (i.e., having a pointed edge) each falling into a dip between two adjacent teeth 31 in a locked position of the buckle 20, two inclined sides 233 (i.e., having a pointed edge), and four resilient members 234 arranged at four corners of a rectangular flange (not numbered) around the hole 231.

The buckle 20 further comprises a cover 40 including two parallel side walls 241 secured to the top of the base 21, front and rear struts 242 formed across the side walls 241, the strap 30 being partially wrapped around each strut 242, and two L-shaped latches 243 each formed at an opening of the side wall 241 between the struts 242, the latch 243 including an outer projecting surface for ease of pushing operation as detailed later, and a hook end 246 disposed inside the cover 40 and engaged with the side 233. An inner surface of the cover 40 under a top bridge 245 thereof is biased by the resilient members 234.

An operation of tightening the buckle 20 of the invention after putting the buckle 20 on the head will be described in detailed below. First, a wearer may press the outer surfaces of the latches 243 toward each other to lift the sides 233 (i.e., the sliding plate 23) along the column 22 with the resilient members 234 being compressed by biasing against the underside of the bridge 245 for storing elastic energy therein as indicated from the position of FIG. 6A to that of FIG. 6B. At the same time, the front and rear ends 232 clear the dip between the teeth 31 as indicated from the circle area of FIG. 5B to that of FIG. 5A. That is, the straps 30 are adapted to freely slide through front and rear portions of the buckle 20 by pulling the free ends of the straps 30 in a direction indicated by arrows of FIG. 5A. After obtaining a desired tightness of the straps 30 (i.e., a sufficient tension has been applied to the straps 30), the wearer may stop the pulling by releasing the latches 243. Immediately, the sliding plate 23 slides downward along the column 22 because the resilient members 234 downward exert an expanding elastic force as indicated from the position of FIG. 6B to that of FIG. 6A. At the same time, the front and rear ends 232 fall into the dip between the teeth 31 again as indicated from the circle area of FIG. 5A to that of FIG. 5B. That is, the straps 30 are prohibited from pulling and the tightness adjustment of the buckle 20 is finished (see FIG. 5B).

Figure 5A:
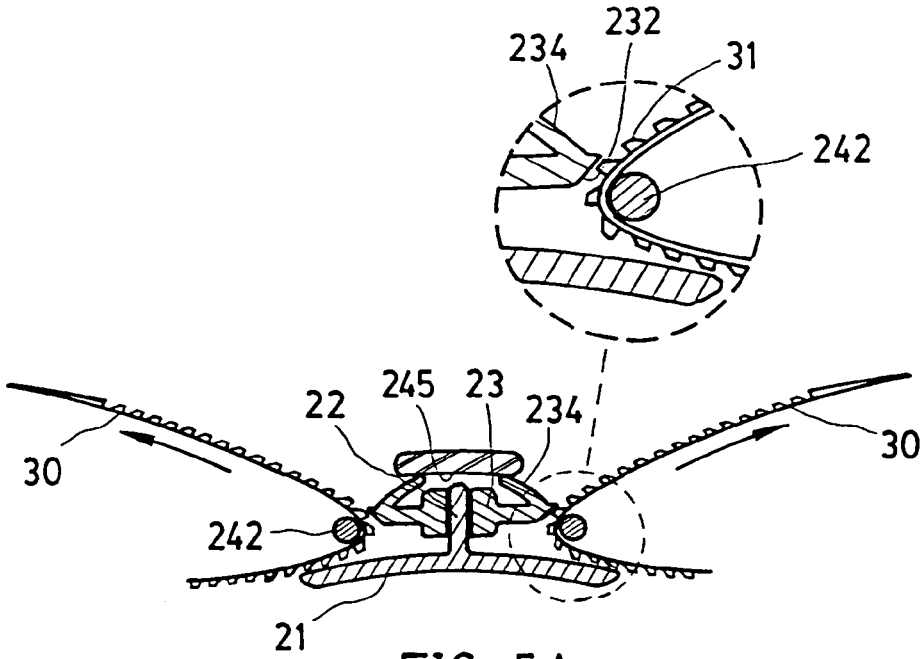
FIG. 5A is a sectional view taken along line 5-5 of FIG. 4 with two straps freely sliding in a strap tightness or looseness adjustment operation.
Figure 5B:
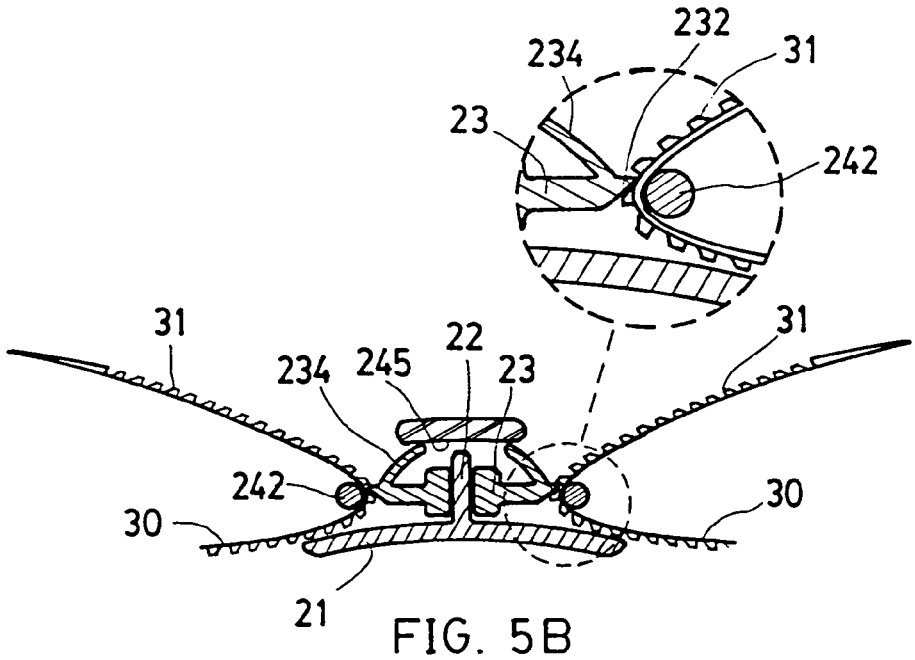
FIG. 5B is a view similar to FIG. 5A with the two straps being locked at the end of strap tightness or looseness adjustment operation.
Figure 6A:
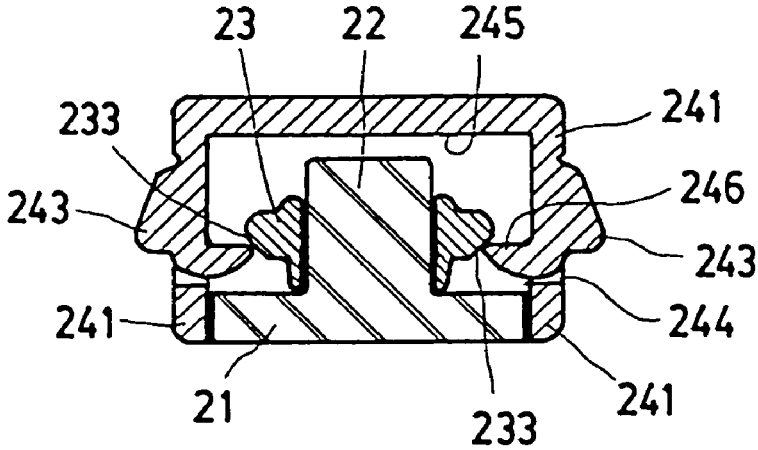
FIG. 6A is a sectional view taken along line 6-6 of FIG. 4 with the latches being in an inoperative position.
Figure 6B:
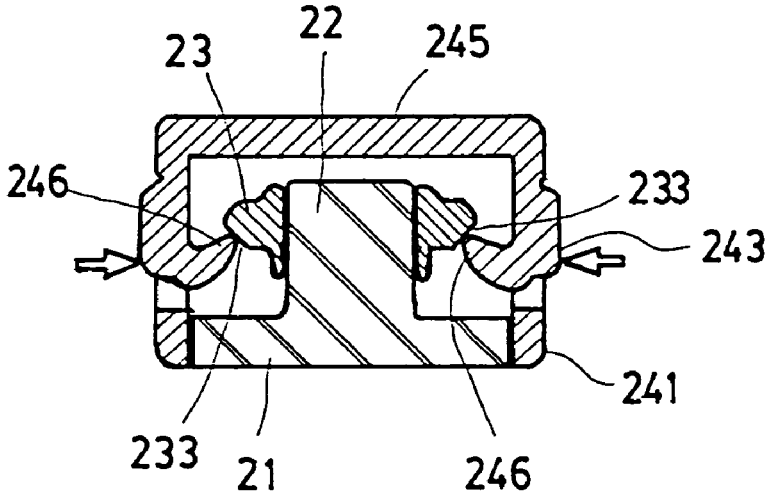
FIG. 6B is a view similar to FIG. 6A with the latches being pushed inward to enable the strap tightness or looseness adjustment.

To the contrary, the wearer may pull the free ends of the straps 30 in a direction opposite to that indicated by arrows of FIG. 5A prior to loosening the buckle 20 and thus removing the mask 10 held to the head.

Figure 7:
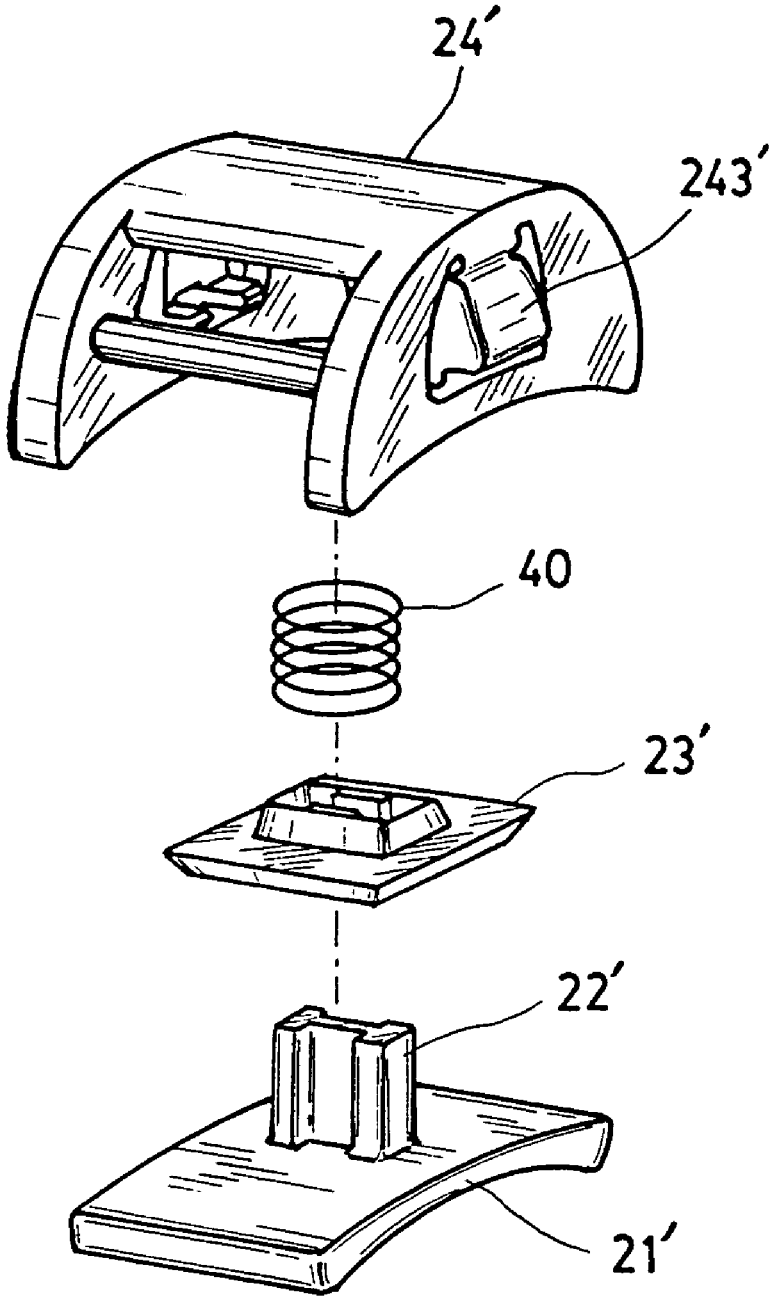
FIG. 7 is a perspective view of a second preferred embodiment of adjustable buckle according to the invention.
Figure 8A:
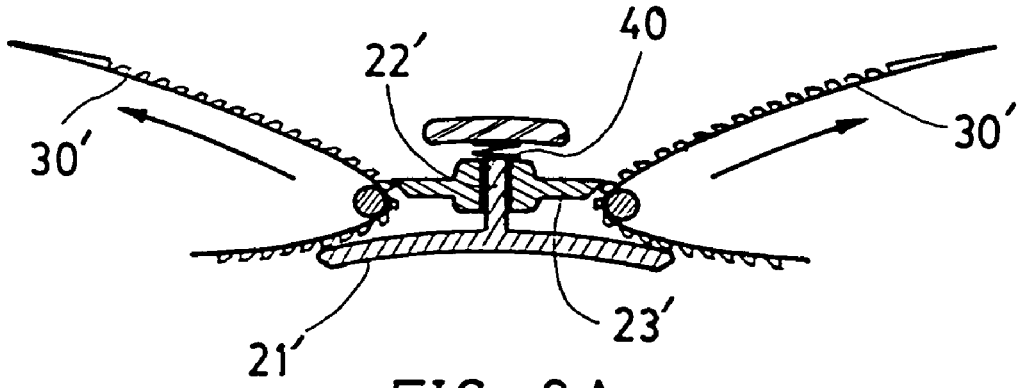
FIG. 8A is a schematic longitudinal sectional view of the assembled buckle shown in FIG. 7 with two straps freely sliding in a strap tightness or looseness adjustment operation.
Figure 8B:
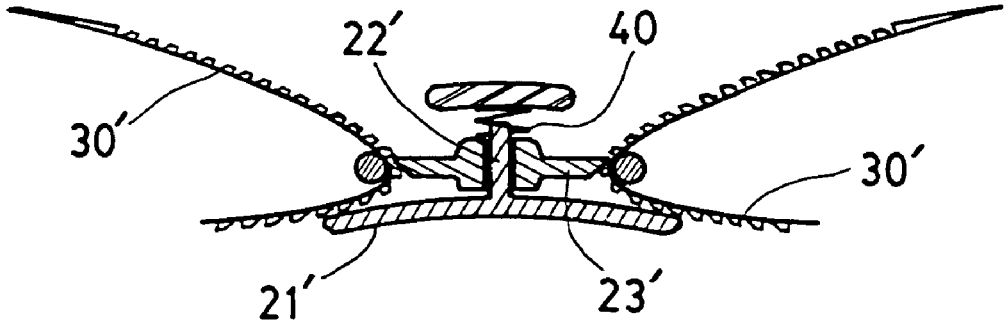
FIG. 8B is a view similar to FIG. 8A with the two straps being locked at the end of strap tightness or looseness adjustment operation.

Referring to FIGS. 7, 8A, and 8B, an adjustable buckle 20 in accordance with a second preferred embodiment of the invention is shown. The second embodiment is identical to the first embodiment, except that the four resilient members 234 are replaced by a coil spring 40 put on an upper portion of the column 22' and biased between the sliding plate 23' and an inner surface of the cover 24' under a top thereof. The strap tightening and loosening operations of the straps 30' are the same as that discussed in the first embodiment and a detailed description thereof is therefore deemed unnecessary.

Figure 9:
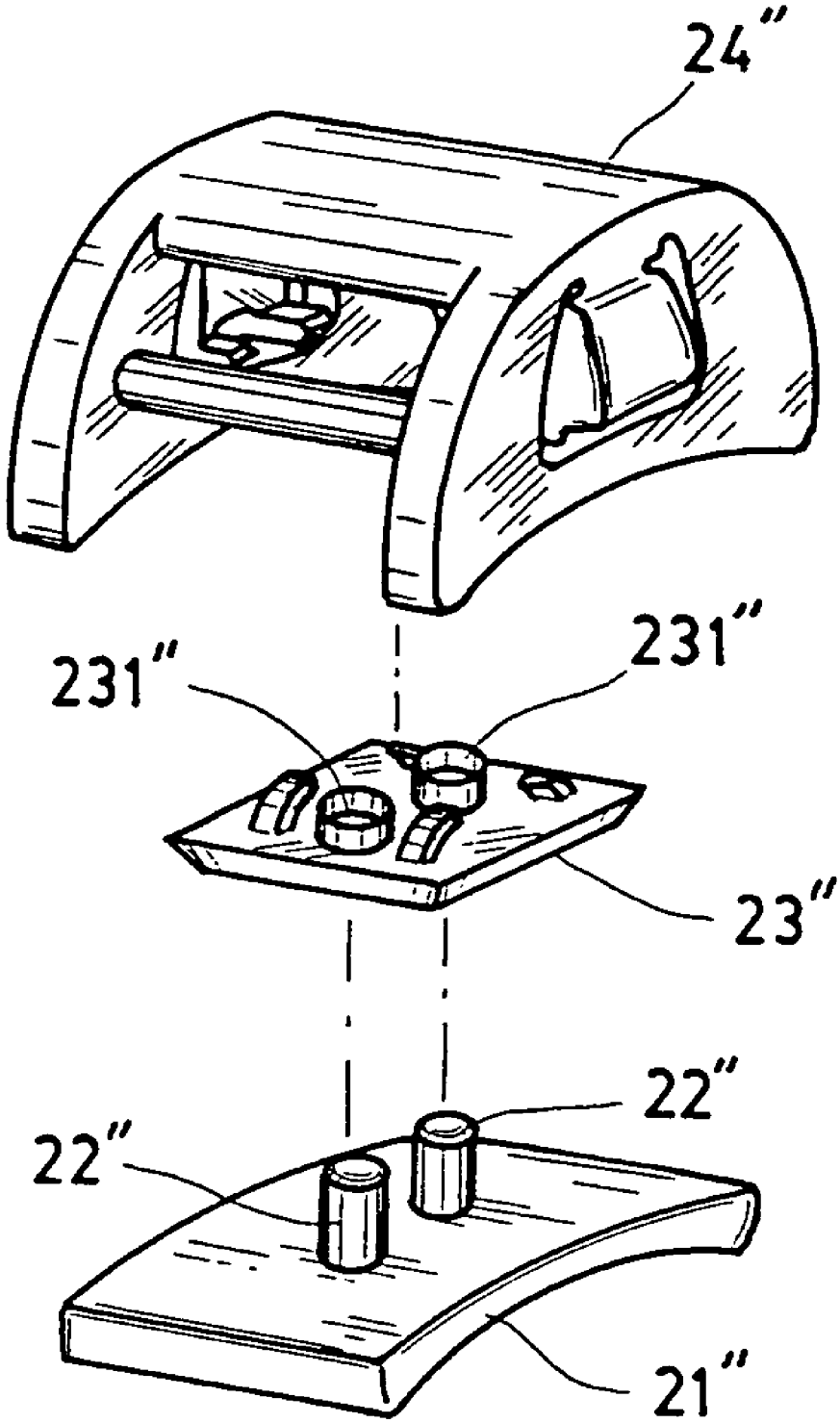
FIG. 9 is a perspective view of a third preferred embodiment of adjustable buckle according to the invention.

Referring to FIG. 9, an adjustable buckle 20 in accordance with a third preferred embodiment of the invention is shown. The characteristics of the third preferred embodiment are detailed below. The single column 22 is replaced by two spaced cylinders 22" disposed along a longitudinal central line on a top of the base 21". Further, the single hole 231 is replaced by two spaced sockets 231" each adapted to slidably receive the cylinder 22" therethrough. Furthermore, the rectangular flange around the hole 231 is eliminated. Likewise, the strap tightening and loosening operations of the straps are the same as that discussed in the first embodiment and a detailed description thereof is therefore deemed unnecessary.

While the invention herein disclosed has been described by means of specific embodiments, numerous modifications and variations could be made thereto by those skilled in the art without departing from the scope and spirit of the invention set forth in the claims.

What is claimed is:

1. A buckle for tightening or loosening two straps joined at the buckle, each strap being extended from either end piece of a mask and having a plurality of equally spaced transverse ratchet teeth formed on an inner surface, comprising:

a base including a top column;

a rectangular sliding plate including a central hole shaped to slidably put on the column, inclined front and rear ends each falling into a dip between two adjacent teeth in a locked position of the buckle, two inclined sides, and a resilient assembly secured on the sliding plate; and a cover including a top bridge, front and rear openings, two parallel side walls secured to the base and each having an opening, front and rear struts formed across the side walls with the strap being partially wrapped around each strut, and two L-shaped latches each formed at the opening of the side wall between the struts, and the latch including a projecting outer surface wherein an end of each latch is disposed inside the cover and engaged with either side of the sliding plate, and wherein a top of the resilient assembly is biased against an inner surface of the bridge, whereby putting the mask on an object and pressing the outer surfaces of the latches toward each other will lift the sliding plate along the column with the resilient assembly being compressed by biasing against the bridge, cause the front and rear ends to clear the dip between the teeth, and enable the straps to freely slide through the front and rear openings of the cover by pulling free ends of the straps in a first direction, and stopping the pulling by releasing the latches will cause the sliding plate to slide downward by an expansion of the resilient assembly, cause the front and rear ends to fall into the dip between the teeth, and lock the straps; and whereby pulling the free ends of the straps in a second direction opposite the first direction will loosen the buckle and enable a removal of the mask from the object.

2. The buckle of claim 1, wherein the resilient assembly comprises four resilient members arranged as four corners of a rectangle around the hole.

3. The buckle of claim 1, wherein the resilient assembly is a coil spring.

4. The buckle of claim 1, wherein the end of each latch is shaped as a hook.

* * * * *